US005950412A

United States Patent [19]

Gabalda et al.

[11] Patent Number: 5,950,412

[45] Date of Patent: Sep. 14, 1999

[54] MACHINE FOR CONTINUOUSLY PLYING OR TWISTING YARNS WITH SUBSEQUENT COMPLEMENTARY HEAT TREATMENT

[75] Inventors: Carlos Matas Gabalda, Granges-les-Valences; Gérard Losson, Valence, both of France

[73] Assignee: ICBT Valence, France

[21] Appl. No.: 08/913,731

[22] PCT Filed: Mar. 20, 1996

[86] PCT No.: PCT/FR96/00415

§ 371 Date: Sep. 23, 1997

§ 102(e) Date: Sep. 23, 1997

[87] PCT Pub. No.: WO96/30573

PCT Pub. Date: Oct. 3, 1996

[30] Foreign Application Priority Data

Mar. 24, 1995 [FR] France ..... 95 03746

[51] Int. Cl.[6] ..... D01H 7/46

[52] U.S. Cl. ..... 57/290; 28/249; 57/58.49; 57/58.52; 57/58.83; 57/58.86; 57/352

[58] Field of Search ..... 28/249; 57/352, 57/290, 58.49, 58.52, 58.54, 58.83, 58.86

[56] References Cited

U.S. PATENT DOCUMENTS

| | | | |
|---|---|---|---|
| 3,022,565 | 2/1962 | Fitzgerald | 57/290 |
| 3,041,813 | 7/1962 | Enneking | 57/290 |
| 3,318,083 | 5/1967 | Gilchrist | 57/290 |
| 3,422,613 | 1/1969 | Berger et al. | 57/290 |
| 3,525,205 | 8/1970 | Antoni et al. | 57/34 |
| 3,763,669 | 10/1973 | Bous et al. | 65/5 D |
| 3,820,316 | 6/1974 | Clarkson | 57/34 HS |
| 4,027,466 | 6/1977 | Brehm | 57/34 HS |
| 4,215,530 | 8/1980 | Beau et al. | 57/310 |
| 4,291,529 | 9/1981 | Schellenberg et al. | 57/352 |
| 4,592,165 | 6/1986 | Charbonnier | 57/58.86 |
| 4,945,720 | 8/1990 | Neyraud | 57/58.86 |
| 5,715,670 | 2/1998 | Bartkowiak | 57/290 |

FOREIGN PATENT DOCUMENTS

| | | |
|---|---|---|
| 1455499 | 9/1966 | France . |
| 2104105 | 4/1972 | France . |
| 2414568 | 1/1978 | France . |

*Primary Examiner*—William Stryjewski
*Attorney, Agent, or Firm*—Wall Marjama Bilinski & Burr

[57] ABSTRACT

An improved machine for continuously twisting or cabling, as well as thermally treating of yarns includes a central stand capable of supporting a plurality of stations. Each station includes a direct cabling or double twist spindle for supporting and twisting or cabling a first yarn package together with a second yarn. The treatment zone is located downstream from the spindle wherein the yarn is delivered using a take-up which eliminates tension resulting from the cabling or twisting operation. The treatment zone includes a vertically disposed oven and adjacent cooling area. A take-up and return system adjacent the oven allows multiple passes to be taken through the oven, as needed, to treat the yarn under minimal tension to the cooling area and to a winding system.

5 Claims, 5 Drawing Sheets

MACHINE FOR CONTINUOUSLY PLYING OR TWISTING YARNS WITH SUBSEQUENT COMPLEMENTARY HEAT TREATMENT

FIELD OF THE INVENTION

The present invention relates to an improved machine making it possible to carry out continuously the twisting or cabling of yarns followed by additional thermal treatment.

BACKGROUND OF THE INVENTION

Machines, used particularly for the production of yarns for carpets, have been provided for a very long time, as emerges particularly from FR-A-1,455,499 and from U.S. Pat. No. 3,525,205. It has also been proposed to use such machines for treating partially drawn synthetic yarns, drawing being carried out at the double-twist spindle, as emerges from FR-A-2,414,568.

As emerges from these documents, such installations consist of a central stand which supports a plurality of identical workstations comprising, as seen in the direction of passage of the yarn:

- a single-twist or double-twist spindle supporting a yarn package,
- means for the take-up of the yarn,
- a thermal treatment oven arranged either vertically (FR-1,455,499) or horizontally (U.S. Pat. No. 3,525,205), followed by a cooling zone, and
- means for winding up the treated yarn.

In such installations, the yarn is maintained in the relaxed state during the thermal treatment and during the cooling phase prior to reeling.

Although the machines which are the subject of the abovementioned patents relate to the twisting of a single yarn, it has been proposed for a very long time to use similar machines for carrying out direct cabling operations, as emerges from U.S. Pat. No. 3,820,316. For this purpose, in such a case, the yarn coming from the package mounted on the spindle is combined with a second yarn which comes from a second reel mounted in a stationary manner on the stand of the machine and which is fed through the shank of the said spindle as far as a cabling head arranged in the extension of the latter.

SUMMARY OF THE INVENTION

Now an improvement upon such a type of machine has been found, this being the subject of the present invention, making it possible to improve the quality of the yarns produced, particularly as regards the feel and appearance of the article, for example a carpet, produced from such yarns.

In general terms, the machine according to the invention is of the type comprising, in a similar way to the teachings of U.S. Pat. No. 3,525,205, a central stand supporting a plurality of identical workstations, each comprising:

- a double-twist or cabling spindle supporting a package of yarn intended to be twisted or cabled together with a second yarn;
- means for the take-up of the yarn, making it possible to eliminate the tension which occurs as a result of the twisting or cabling operation;
- yarn-heating means followed by a cooling zone; and
- means for winding up the treated yarn.

In a similar way to the teachings of U.S. Pat. No. 3,820,316, in the machine according to the invention, which makes it possible to carry out both a twisting operation and a direct cabling operation, is characterized in that:

- the heating means consist of a rectilinear oven arranged vertically or approximately vertically
- the yarn executes a to-and-fro movement inside the said oven, a return system for said yarn being provided to an extremity of said oven in order to realize this to-and-fro.

This machine is characterized in that:

- the yarn is introduced into and extracted from the oven by way of its lower end;
- the return system is arranged at the top of the oven and is constituted by a take-up system;

the capability of perfectly controlling the tensions imparted to the yarn during the phases of thermal treatment and of cooling. Such a possibility is achieved due to the presence of the take-up system which is provided in the upper part of the oven and which makes it possible to impart an exact constant tension during the period of the rise in temperature, which takes place between the entry delivery means and the said return and take-up member, and then to maintain the yarn in the completely relaxed state during the second passage through the oven and through the cooling zone.

In a first embodiment according to the invention, after thermal treatment and before winding, the yarn is received on a moving relaxation belt, where it forms a reserve, the receiving speed of the winding assembly being regulated so that the quantity of yarn put in reserve is maintained between two predetermined minimum and maximum values.

In another embodiment, the cooled path of the yarn is provided by means of rotary guide elements interposed between the exit of the oven and a tensioner positioned upstream and in the plane of symmetry of the winding system.

In both embodiments, the double-twist spindle and the winding system are advantageously positioned one above the other and are offset laterally in relation to the setting oven.

However, the invention and the advantages which it affords will be understood better from the exemplary embodiments which are given below and which are illustrated by the accompanying diagrams in which:

DETAILED DESCRIPTION OF THE INVENTION

Figure 1:
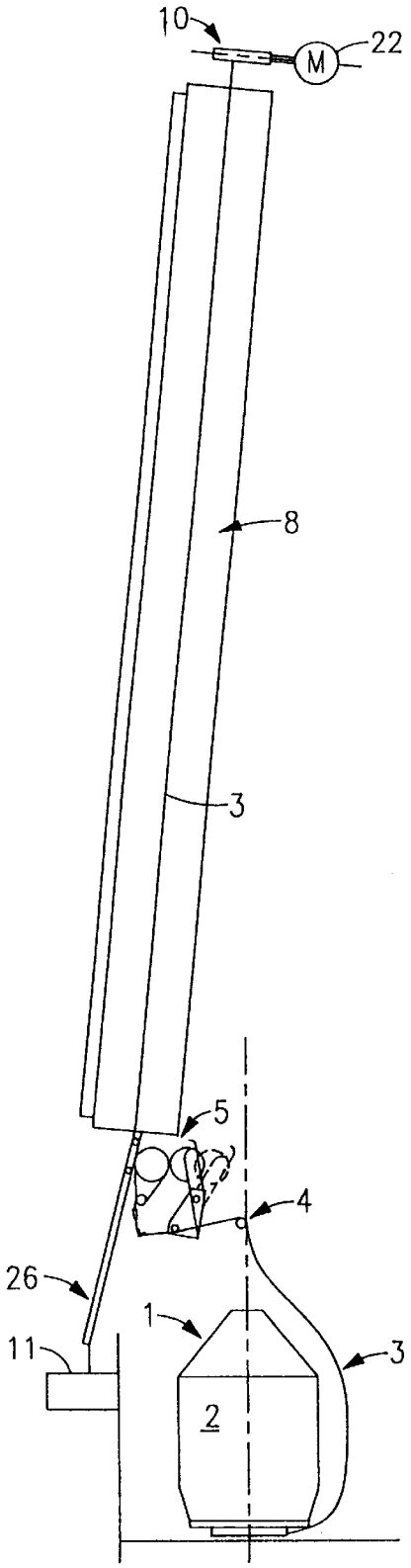
FIG. 1 and 2 are a side view and a front view, respectively, of a workstation of a machine according to the invention.

Referring to these figures, each workstation of a machine according to the invention comprises a conventional double-twist or cabling spindle (1) making it possible to carry out either twisting in the conventional way or a direct cabling operation. Preferably, the spindle is driven by an individual motor and therefore supports a reel (2) of the yarn (3) to be treated. The double-twist spindle (1) makes it possible to impart to the yarn (3) two twisting turns for each revolution of the said spindle. When the said spindle is used for carrying out a direct cabling operation, it has a hollow shank, and a second yarn is fed through the latter in order to be combined with the yarn (3), carried by the spindle, at a cabling head (4) which is arranged in the extension of the axis of the said spindle (1).

The actual treatment zone is arranged downstream of the double-twist or direct cabling assembly (1).

This treatment zone comprises, in the direction of the path of the yarn, a delivery means (5) of the positive type.

Figure 6:
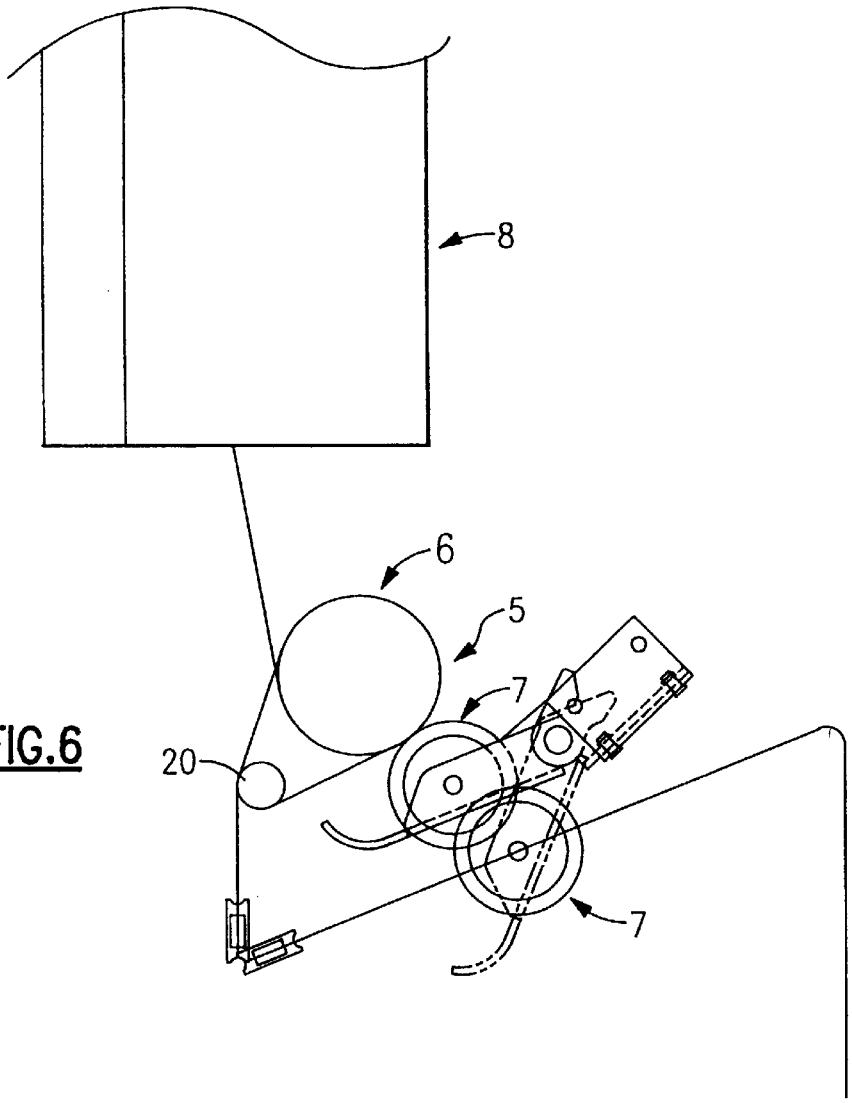
FIGS. 6 and 7 are partial views showing, in a side view (FIG. 6) and in a front view (FIG. 7), the structure of the take-up device arranged at the entrance of the oven.
Figure 7:
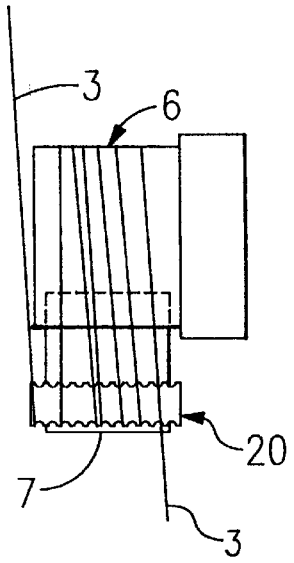

This delivery means is advantageously of the type illustrated in FIGS. 6 and 7 and is composed essentially of an assembly of the type with a capstan (6) and with a pressing cylinder (7), the said assembly making it possible, in association with a grooved cylinder (20) (see FIG. 7), to achieve a reeving of the yarn (3) (or of the cabled yarn) and therefore very high accuracy in the speed of take-up of the said yarn as well as to eliminate the tension which occurs as a result of the twisting or cabling operation.

Figure 2:
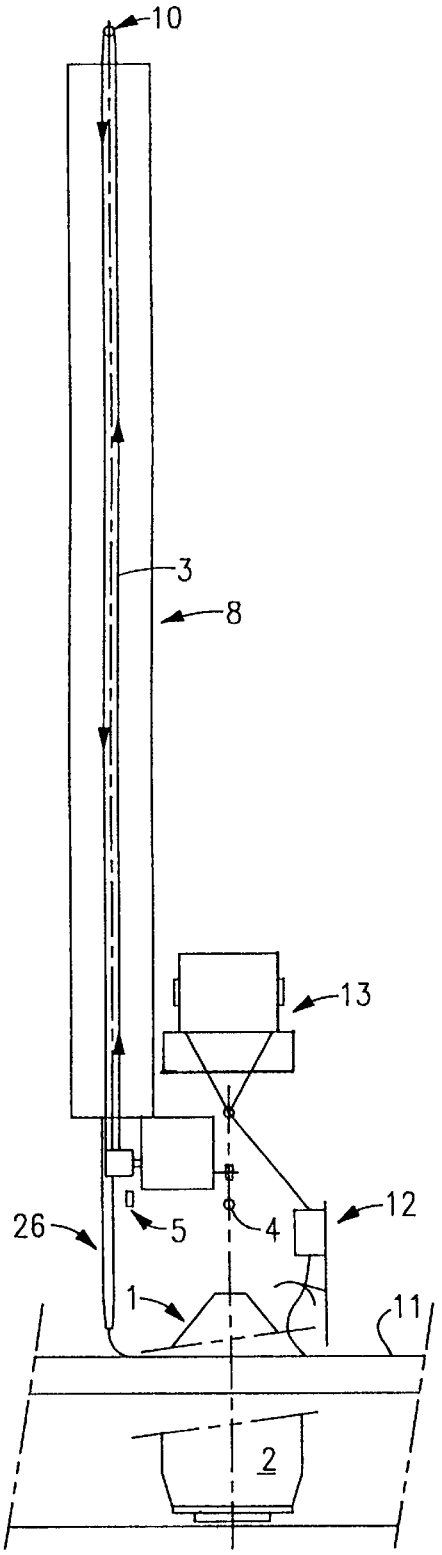

It should be noted that, for the sake of clarity, the yarn (3) has not been illustrated in FIG. 2 between the exit of the spindle (2) and the delivery means (5). Moreover, the pressing cylinder (7) is shown in the inoperative position in FIG. 6 by thin lines.

The delivery means (5) is arranged at the entrance of the actual thermal treatment oven (8), the said oven being arranged vertically or approximately vertically, as illustrated in the accompanying figures, where it forms an angle of approximately five degrees with the vertical.

This oven is a conventional oven of the type used on false-twist texturing equipment.

According to the invention, a take-up and return system, designated by the general reference (10), is arranged at the top of the oven, the said system making it possible to cause the yarn to execute a second passage through the oven (8), during which it is maintained in the completely relaxed state.

Figure 9:
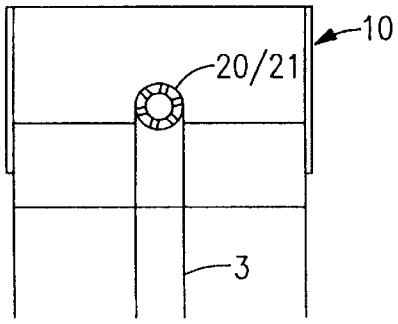
FIGS. 8 and 9 are enlarged partial views showing a side view and a front view of the structure of an embodiment of the take-up device provided at the top of the oven.
Figure 8:
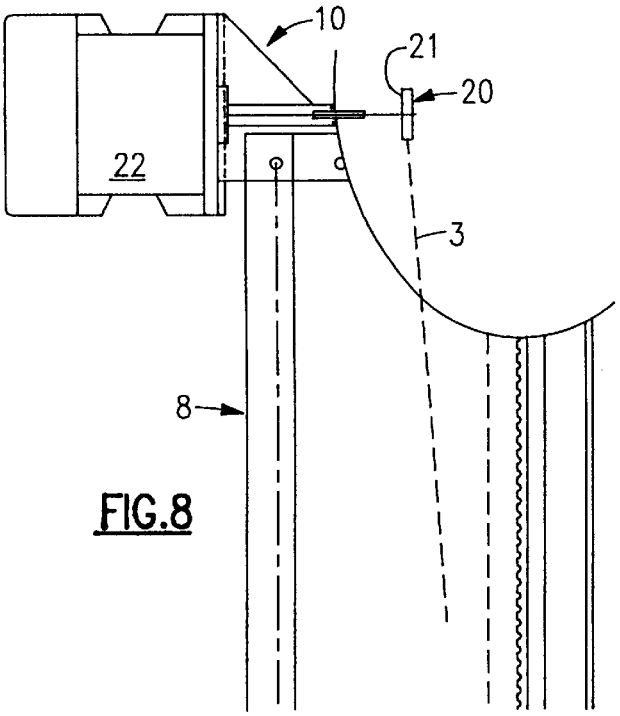

According to the embodiment illustrated in FIGS. 8 and 9, this take-up and return system (10) consists of an assembly of the "yarn detensioner" or "overspeed delivery means" type, comprising two dishes (20, 21) between which the yarn passes and which are rotated positively, preferably by means of an individual motor (22), as illustrated in FIGS. 8 and 9. Such a delivery means can drive the yarn by sliding and takes up the latter at a speed higher than the normal run-off speed. It makes it possible, as a function of the variations in the speed of take-up of the yarn, to obtain automatic self-regulation of the consists of an assembly of the "yarn detensioner" or "overspeed delivery means" type, comprising two dishes (20, 21) between which the yarn passes and which are rotated positively, preferably by means of an individual motor (22), as illustrated in FIGS. 8 and 9. Such a delivery means can drive the yarn by sliding and takes up the latter at a speed higher than the normal run-off speed. It makes it possible, as a function of the variations in the speed of take-up of the yarn, to obtain automatic self-regulation of the tension at the exit of the delivery means, this tension being maintained at a very low value.

Figure 11:
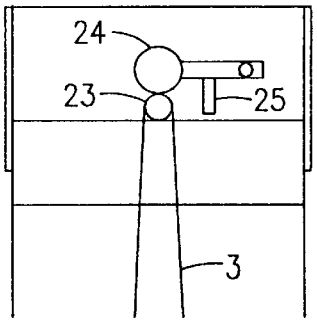
FIGS. 10 and 11 are likewise partial side and front views of a second type of take-up device which can be used at the top of the oven.
Figure 10:
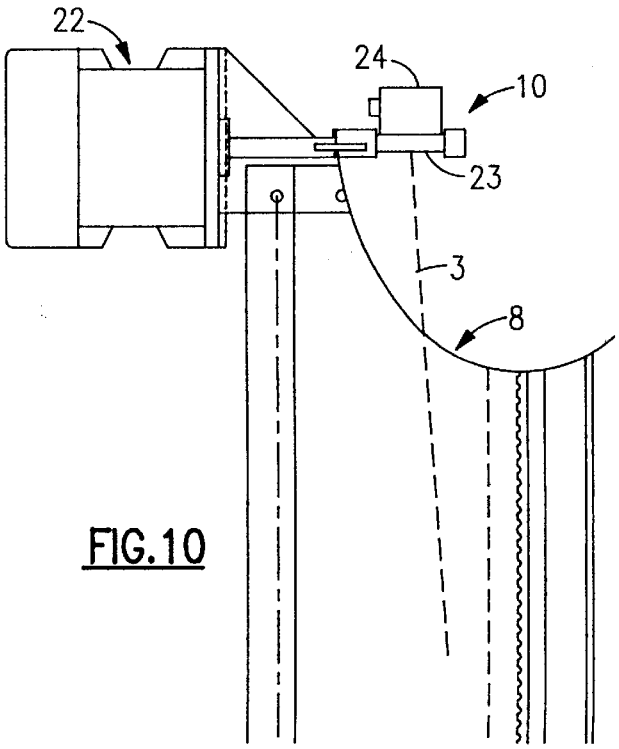

According to another embodiment, as illustrated in FIGS. 10 and 11, the take-up and return system (10) can consist of a positive delivery means of the press-roller type. In such a case, the yarn (3) passes over the surface of a cylindrical guide (23) likewise rotated by means of a motor (22), and the roller (24), subjected to the action of a restoring element (25) (spring), exerts pressure on the yarn.

At the exit of the take-up and return system (10), as stated above, the yarn (3) passes through the oven (8) a second time, being maintained under a minimal tension. The vertical or approximately vertical position of the oven (8) makes it possible to take advantage of gravity so that the yarn remains perfectly straight.

At the exit of the oven (8), the yarn is transferred, preferably by means of a guide chute (26), to means for cooling the yarn in the relaxed state. The guide chute (26) has a V-shaped cross-section.

Figure 5:
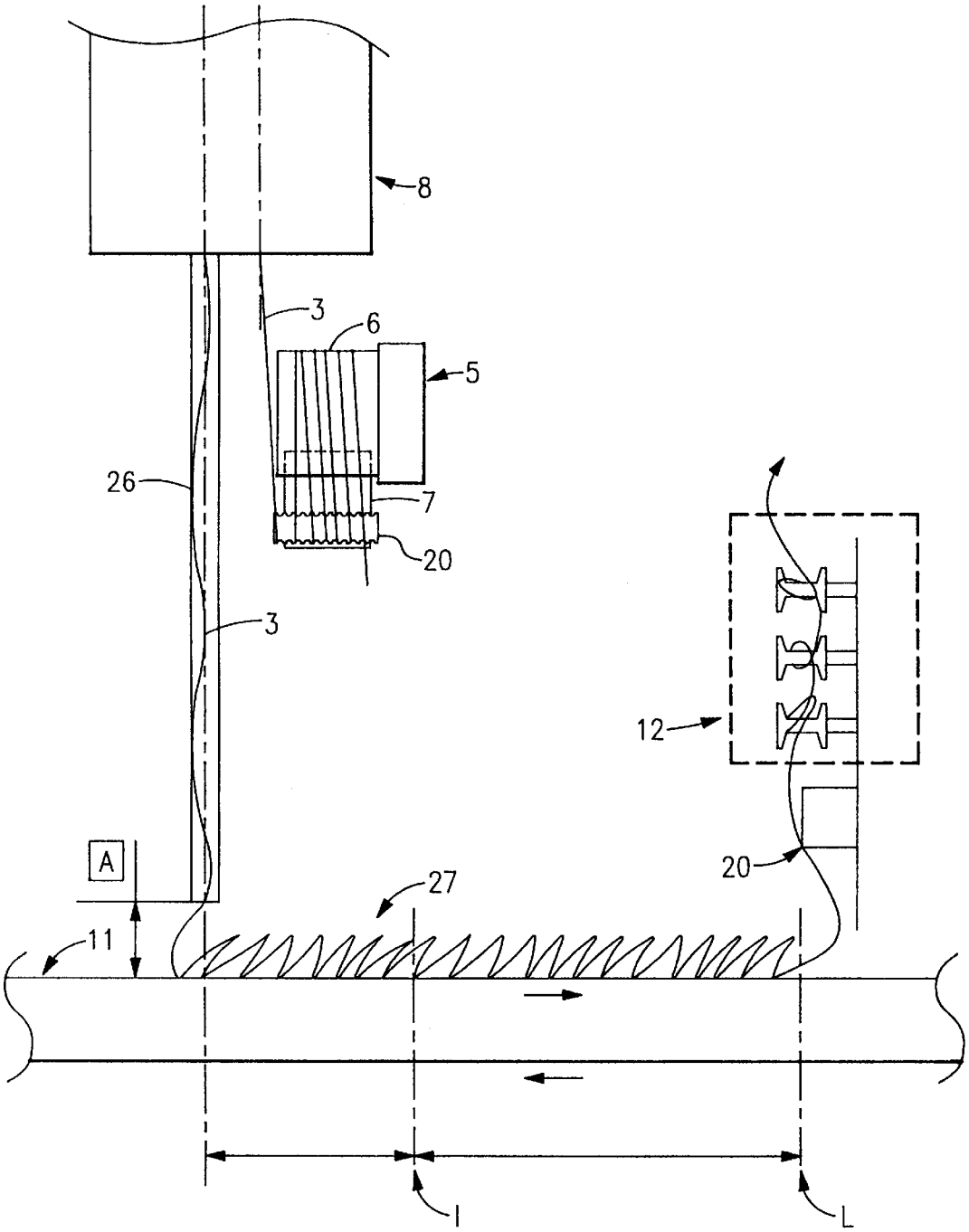
FIG. 5 is a diagrammatic detail view of the means used for relaxing the yarn during its cooling phase in the embodiment illustrated in FIGS. 1 and 2.

In the first embodiment illustrated in FIGS. 1, 2 and 5, the means for cooling the yarn in the relaxed state consist of a relaxation belt (11) arranged horizontally below the oven (8). This belt may be either individual for each workstation or common to all the stations and, in that case, extends over the entire width of the machine.

After relaxation, the yarn (3) passes over a recovery system (12), in order subsequently to be fed to the conventional winding means (13).

The receiving speed of the winding assembly (13) is adjusted by means of a reserve detector (20) which makes it possible to bring about an acceleration for a given duration, so that the yarn (3) put in reserve in the form of turns is maintained between two predetermined minimum l and maximum L values, for example between 150 mm and 350 mm in length.

Figure 3:
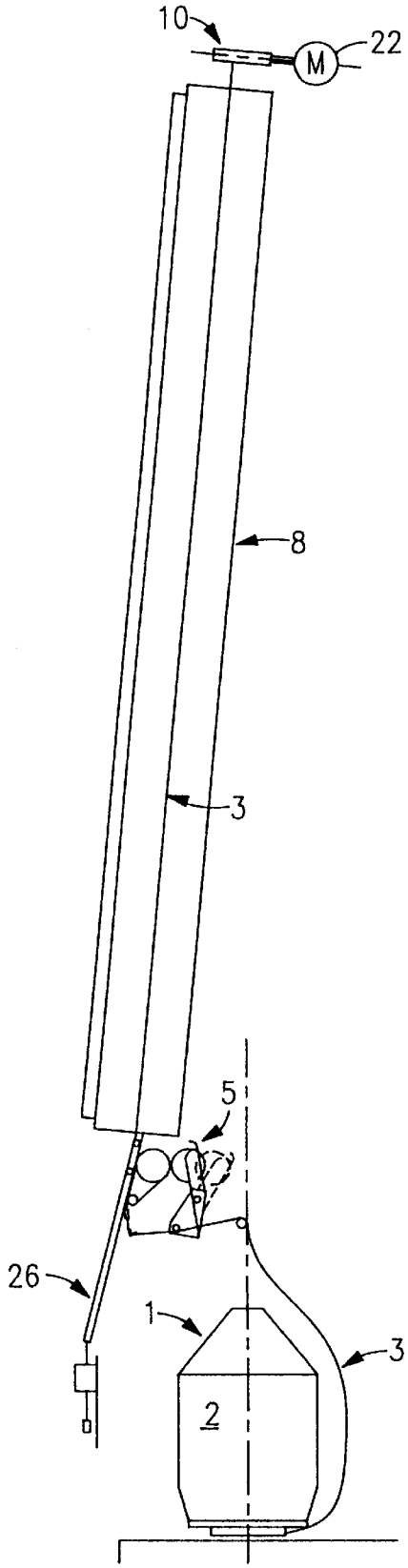
FIGS. 3 and 4 are views, similar to those of FIGS. 1 and 2, of a variant relating to how the cooling of the yarn is carried out on a machine according to the invention.
Figure 4:
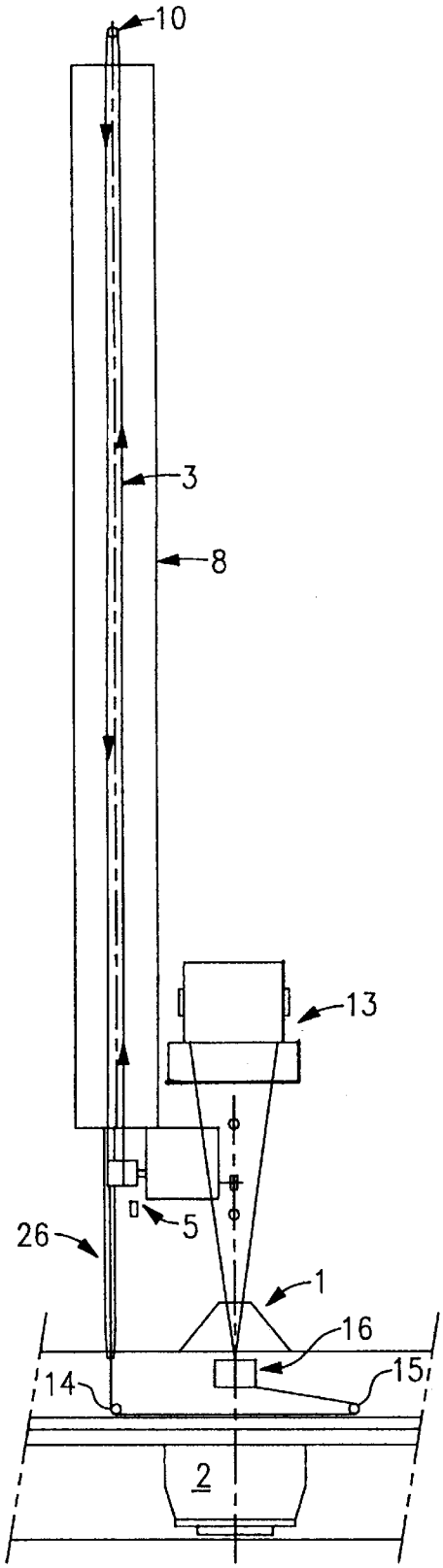

In the second embodiment illustrated in FIGS. 3 and 4, the cooling of the yarn is carried out by causing it to pass around return elements consisting of freely rotating rollers (14, 15), the yarn being fed to the winding system (13) by means of a hysteresis brake (16) which is adjusted so that the said yarn (3) is maintained, upstream, under minimal tension.

Such a machine design has numerous advantages over the solutions of the prior art, particularly as regards its flexibility of use, thus allowing the production of a wide variety of different yarns, this being achieved simply by adjusting the tensions which are imparted to the yarns in the various treatment zones, as demonstrated by the concrete examples given below as a non-limiting indication.

EXAMPLE 1

Production of a yarn of the cabled type consisting of two polyamide yarns each having a linear density of 1250 dtex and being twisted at 160 turns/metre Such a yarn is produced on the machine according to the invention, as illustrated in FIGS. 1 and 2, the yarn (3), which comes from the reel carried by the spindle, being combined at the cabling point (4) with a second yarn (not shown) which comes from an additional support mounted on the stand of the machine and fed through the hollow shank of the spindle.

The machine settings for producing such a cabled yarn are as follows:

| | |
|---|---|
| speed of the spindle (1) allowing direct cabling: | 1500 revs/min |
| twist imparted by the spindle (1): | 160 turns/m |
| speed of the take-up (5): | 40.6 m/min. |
| length of the oven (8): | 2.25 m |
| speed of the take-up and return element (10): | 47 m/min. |

-continued

| | |
|---|---|
| tension of the yarn during the first passage between the delivery means (5) and the take-up (10): | 3 grams |
| tension of the yarn during the second passage and in the cooling zone: | 0 grams |
| winding tension downstream of the tensioner (12): | 140 grams |
| receiving speed of the winding means (13): | 40 m/min. (an average) |
| storage length on the conveyor belt (11) during the cooling phase: | between 15 and 30 cm |
| temperature of the oven (8): | 220° C. |

Such a procedure makes it possible to obtain a yarn which can be used for the production of carpets and which has an improved appearance and feel in comparison with articles produced from conventional yarns.

EXAMPLE 2

Production of a carpet yarn from a polyamide 6.6 yarn having a linear density of 2100 dtex and a twist of 70 turns/metre This yarn is produced on a machine according to the invention, as illustrated in FIGS. 3 and 4, and under the following conditions:

| | |
|---|---|
| speed of the double-twist spindle (1): | 2625 revs/min |
| twist imparted by the spindle (1): | 70 turns/m |
| speed of the take-up (5): | 75 m/min. |
| length of the oven (8): | 2.25 m |
| speed of the take-up and return element (10): | 85 m/min. |
| tension of the yarn during the first passage between the delivery means (5) and the take-up (10): | 5 grams |
| tension of the yarn during the second passage and in the cooling zone: | 3 grams |
| winding tension downstream of the tensioner (12): | 140 grams |
| receiving speed of the winding means (13): | 74 m/min. (on average) |
| distance between the two guides (14, 15) defining the cooling length: | 200 cm |
| temperature of the oven (8): | 220° C. |

We claim:

1. A machine for continuously twisting or cabling of yarns followed by additional thermal treatment, said machine comprising at least one workstation, said at least one workstation comprising:

one of a double-twist and direct cabling spindle for supporting a first yarn to be twisted or cabled integrally to a second yarn;

first take-up means for taking up the twisted or cabled yarn from said spindle, said first take-up means being capable of substantially eliminating the tension occurring during the twisting or cabling operation;

yarn heating means for thermally treating said yarn, said yarn heating means being adjacent said first take-up means and comprising a long rectilinear oven having at least one opening adjacent one end thereof through which said yarn taken-up by said first take-up means enters and exits said oven;

second take-up means for taking up said yarn through said oven, said second take-up means being disposed adjacently an opposite end of said oven from said at least one opening, said second take-up means including return means for returning said yarn to said at least one opening thereby defining a portion of a yarn travel path extending over at least two passes of the length of said oven, cooling means adjacent said at least one opening for providing a cooling phase for thermally treated yarn exiting said oven;

winding means for winding the treated yarn disposed downstream of said cooling means along said yarn travel path; and detensioning means for maintaining the treated yarn under minimal tension during said cooling phase and for delivering said yarn to said winding means.

2. A machine as recited in claim 1, wherein the detensioning means includes a relaxation belt upon which the treated yarn forms a reserve, and in which a receiving speed of said winding means is regulated such that the quantity of treated yarn put in reserve on said relaxation belt is maintained between predetermined minimum and maximum values.

3. A machine as recited in claim 2, wherein the treated yarn is transferred onto said relaxation belt by means of a guide chute having a V-shaped cross-section, said treated yarn being deposited onto said relaxation belt in the form of turns, and in which the distance between the end of the guide chute and the surface of the belt governs the formation of the turns.

4. A machine as recited in claim 1, wherein said cooling means includes a plurality of rotary guide elements interposed between said at least one opening of said yarn heating means and a tensioner positioned upstream and along an axis of symmetry of the winding means.

5. A machine as recited in claim 1, wherein the second take-up means includes one of a yarn detensioner and an over-speed delivery means.

* * * * *